US006430263B1

(12) United States Patent
Lu et al.

(10) Patent No.: US 6,430,263 B1
(45) Date of Patent: Aug. 6, 2002

(54) COLD-PLATE WINDOW IN A METAL-FRAME X-RAY INSERT

(75) Inventors: Qing Kelvin Lu, Aurora; Andrew R. Kaczmarek, Compton; Paul M. Xu, Oswego, all of IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 33 days.

(21) Appl. No.: 09/729,144

(22) Filed: Dec. 1, 2000

(51) Int. Cl.[7] ..... H01J 35/18
(52) U.S. Cl. ..... 378/140; 378/127; 378/199
(58) Field of Search ..... 378/121, 140, 378/130, 127, 199, 200

(56) References Cited

U.S. PATENT DOCUMENTS 5,610,968 A * 3/1997 Deucher et al. ..... 378/199
5,689,541 A * 11/1997 Schardt ..... 378/140
6,263,046 B1 * 7/2001 Rogers ..... 378/141

* cited by examiner

*Primary Examiner*—David P. Porta
*Assistant Examiner*—Therese Barber
(74) *Attorney, Agent, or Firm*—Fay, Sharpe, Fagan, Minnich & McKee, LLP

(57) ABSTRACT

A CT scanner comprises an x-ray window mounted on an x-ray tube, a cooling fluid circulation line, and a cooling fluid return line. A cold-plate is operatively mounted on the x-ray tube around the x-ray window. The cold plate includes an elongated shell and corrugated fins for rapidly removing heat from the x-ray window. The circulation line is in fluid communication with an inlet of the cold-plate, a cooling fluid reservoir defined between the x-ray tube and a surrounding housing, and a heat exchanger. The return line is in fluid communication with an outlet of the cold-plate, the cooling fluid reservoir, and the heat exchanger. A pump circulates the cooling fluid through the heat exchanger, the suction and return lines, the cold-plate, and the x-ray tube housing.

23 Claims, 3 Drawing Sheets

COLD-PLATE WINDOW IN A METAL-FRAME X-RAY INSERT

BACKGROUND OF THE INVENTION

The present invention relates to the radiographic arts. It finds particular application in conjunction with x-ray tubes for computerized tomographic (CT) scanners and will be described with particular reference thereto. However, it is to be appreciated that the present invention may also be amenable to x-ray tubes for other applications.

CT scanners have commonly included a floor-mounted frame assembly which remains stationary during a scan. An x-ray tube is mounted to a rotatable frame assembly which rotates around a patient receiving examination region during the scan. Radiation from the x-ray tube traverses the patient receiving region and impinges upon an array of radiation detectors. Using the position of the x-ray tube during each sampling, a tomographic image of one or more slices through the patient is reconstructed.

The x-ray tube assembly typically comprises a lead lined housing containing a vacuum envelope or x-ray insert which holds a rotating anode and a stationary cathode. Cooling oil is flowed between the x-ray insert and the housing. In large, high performance x-ray tubes, the x-ray insert may be a metal shell or frame with a beryllium window mounted or brazed thereon for allowing the transmission of x-rays from the x-ray insert. Likewise, the housing defines an x-ray output window that is in alignment with the beryllium window of the x-ray insert such that x-rays may pass directly through the beryllium window and the x-ray output window.

During x-ray generation, electrons are emitted from a heated filament in the cathode and accelerated to a focal spot area on the anode. Upon striking the anode, some portion of the electrons, or secondary electrons, are bounced to the surrounding frame and converted into heat. The beryllium window receives the highest intensity of the secondary electron heating because the window is closer to the focal spot on the anode. The heat is undesirable and is commonly termed waste heat. One of the persistent problems in CT scanners and other radiographic apparatus is dissipating the waste heat created while generating x-rays.

In order to remove the waste heat, a cooling oil is often circulated through the housing and around the x-ray insert forming a cooling jacket around the x-ray insert. For example, oil may be drawn through an output aperture located at one end of the housing, circulated through a radiator or heat exchanger and returned to an inlet aperture in the opposite end of the housing. The returned cooled fluid flows axially through the housing toward the outlet aperture, absorbing heat from the x-ray insert.

Removing waste heat in this manner is not always completely effective. More specifically, waste heat removal by merely forcing coolant to flow between the x-ray insert and the housing is particularly ineffective around the x-ray output window. The beryllium window and its environs, being the recipient of the secondary electrons and heat from the closely adjacent focal spot, is preferentially heated. Further, the beryllium window protrudes out from the frame and generally disrupts the flow of coolant around the window preventing optimal cooling. Additionally, the configuration of the x-ray output window on the housing disrupts coolant flow and, by its proximity to the beryllium window, limits the amount of coolant capable of passing over the beryllium window.

When the window is not sufficiently cooled, the heat can damage the braze joint between the beryllium window and the x-ray insert causing the x-ray tube to fail. Further, the coolant adjacent to the beryllium window may boil and leave a carbon residue on the beryllium window. Such a coating is undesirable as it may degrade the quality of the x-ray image.

The present invention provides a new and improved cooling system and technique for overcoming the above-reference drawbacks and others.

SUMMARY OF THE INVENTION

The present invention relates to the use of a cold-plate on the x-ray window of an x-ray insert to provide for the removal of undesirable waste heat from an x-ray tube.

In accordance with one aspect of the present invention, a CT scanner comprises an x-ray tube assembly mounted on a rotating frame portion. The x-ray tube assembly includes a housing, an x-ray tube operatively mounted within the housing, and a cooling fluid reservoir defined between the x-ray tube and the housing. The cooling fluid reservoir includes an inlet aperture through the housing and an outlet aperture through the housing. The CT scanner also comprises an x-ray window mounted on the x-ray tube, a cooling fluid circulation line, and a cooling fluid return line. The circulation line is in fluid communication with the inlet aperture of the cooling fluid reservoir and with a heat exchanger. The return line is in fluid communication with the heat exchanger and the outlet aperture of the cooling fluid reservoir. The CT scanner additionally comprises a pump and a cold-plate mounted on the x-ray tube around the x-ray window. The pump circulates the cooling fluid through the heat exchanger, the suction and return lines, and the x-ray tube housing assembly.

In accordance with another aspect of the present invention, an x-ray tube assembly comprises a housing, an x-ray tube, and a cold-plate. The housing has an x-ray window and defines a housing cavity therein. The x-ray tube includes a vacuum envelope which holds an anode and a cathode. The vacuum envelope has an x-ray translucent window adjacent the anode. The x-ray tube is mounted in the housing cavity spaced from the housing to define a cooling fluid reservoir therebetween and the x-ray translucent window is aligned with the x-ray window. The cold-plate is operatively mounted on the x-ray translucent window.

In accordance with another aspect of the present invention, an x-ray tube comprises a cold plate and a vacuum envelope having an anode and a cathode with an x-ray window mounted thereon adjacent the anode. The cold plate includes an elongated shell and a plurality of heat transfer elements positioned therein. The shell is operatively mounted around the x-ray window and circumferentially oriented relative to the vacuum envelope. The shell includes an inlet defined in a first end, an outlet defined in an opposite end, and an expansion section disposed therebetween.

In accordance with another aspect of the present invention, a method of cooling an x-ray tube is provided. A first portion of a cooling fluid is circulated over an x-ray tube to remove heat. A second portion of the cooling fluid forced around an x-ray translucent window disposed on the x-ray tube removes heat from the window. The cooling fluid is cooled and recirculated around the window and over the x-ray tube.

The advantages of the present invention include the ability to prevent or reduce the risk of thermal damage to the joint between the beryllium window and the x-ray insert.

Another advantage resides in reducing or preventing failure of the x-ray tube due to overheating.

Another advantage of the present invention resides in reducing or preventing carbon build-up on the beryllium window due to overheating of the cooling fluid.

Another advantage of the present invention resides in maintaining the dielectric characteristics of the cooling fluid to decrease the possibilities of high-voltage instabilities.

Still other advantages and benefits of the invention will become apparent to those skilled in the art upon a reading and understanding of the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
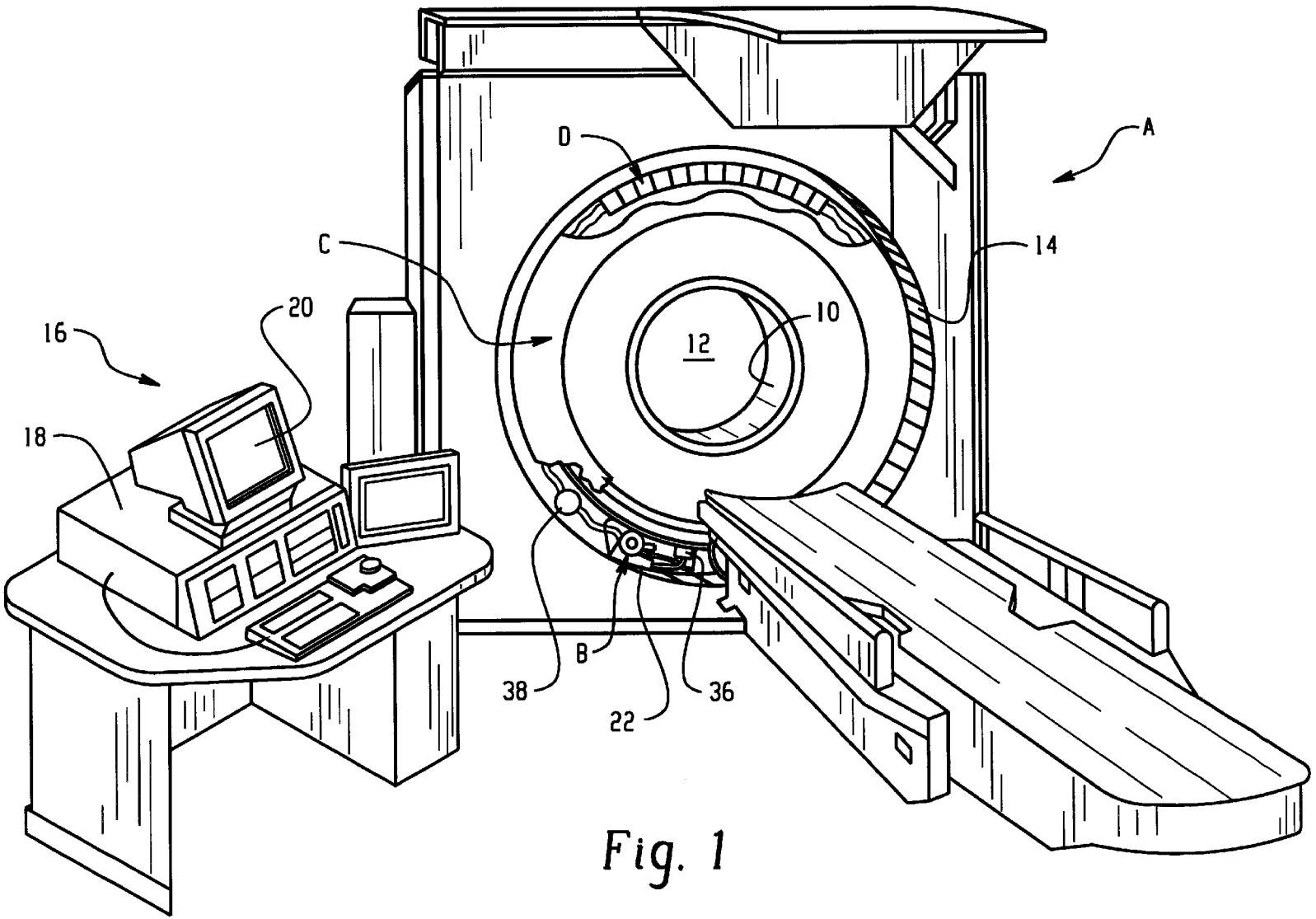
FIG. 1 is a diagrammatic illustration of a CT scanner in accordance with the present invention.

With reference to FIG. 1, a CT scanner includes a floor mounted or stationary frame portion A whose position remains fixed during data collection. An x-ray tube B is mounted on a rotating frame C rotatably mounted within the stationary frame portion A. Heat generated by the x-ray tube B is transferred to a heat exchanger D by a cooling fluid, such as oil, water, refrigerant gas, other fluids and combinations thereof.

The stationary frame portion A includes a bore 10 that defines a patient receiving examination region 12. An array of radiation detectors 14 are disposed concentrically around the patient receiving region 12. The stationary frame A with the rotating frame C can be canted or tipped to scan slices at selectable angles. A control console 16 contains an image reconstructing processor 18 for reconstructing an image representation of output signals from the detector array 14, performing image enhancements, and the like. A video monitor 20 converts the reconstructed image representation into a human readable display. The console 16 also includes appropriate digital recording memory media for archiving the image representations. Various control functions, such as initiating a scan, selecting among different types of scans, calibrating the system, and the like are also performed at the control console 16.

Figure 2:
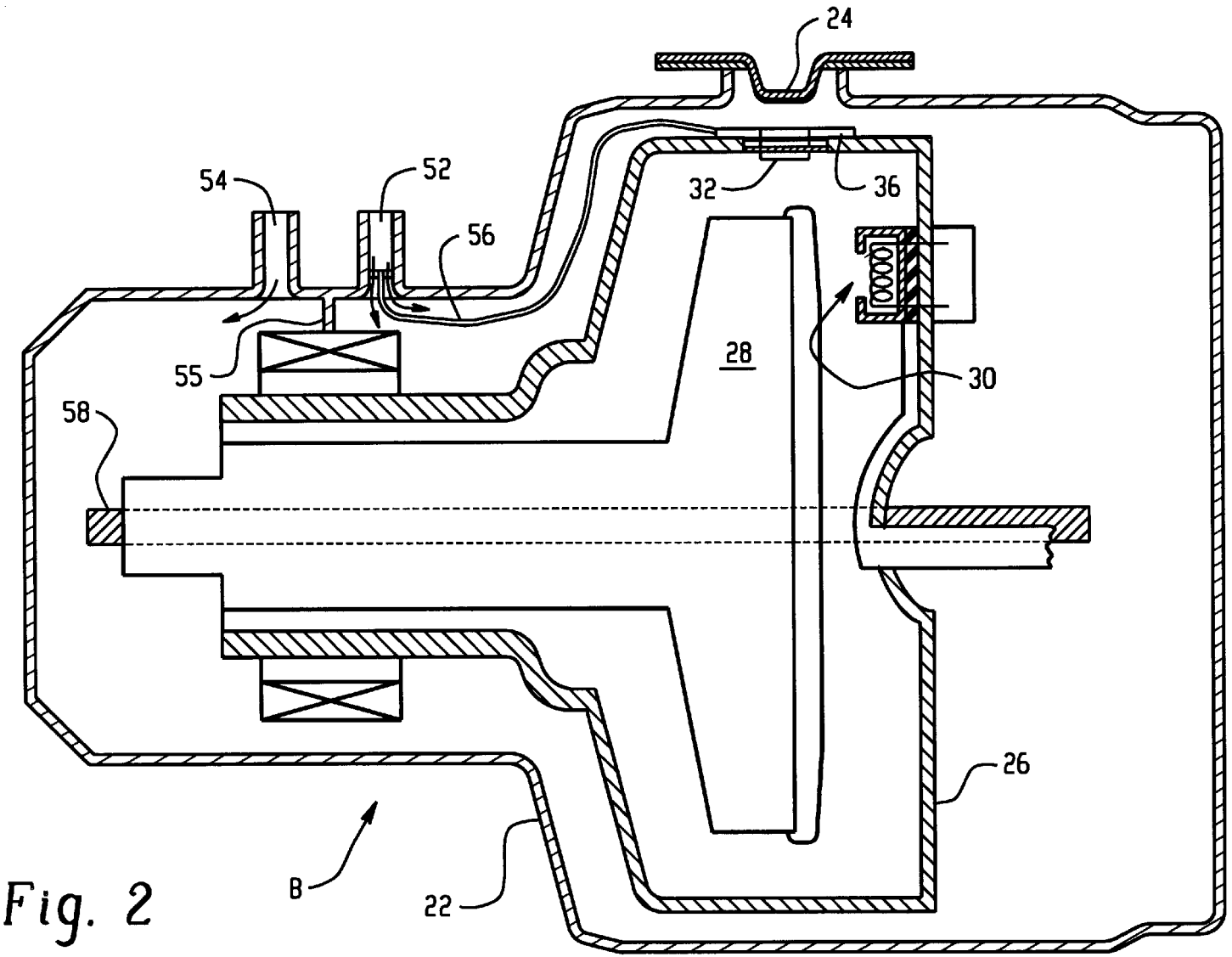
FIG. 2 is a diagrammatic cross-sectional illustration of the x-ray tube assembly of FIG. 1.

With further reference to FIG. 2, the x-ray tube B includes a housing 22 having an x-ray permeable window 24 directed toward the patient receiving region 12 and an x-ray insert 26 mounted in the housing 22. The x-ray insert 26 can be made of glass, ceramic or metal. A rotary anode 28 is rotatably mounted in the x-ray insert 26 by bearings and a cathode 30 is mounted adjacent the rotary anode 28. Electrons from the cathode 30 are propelled by high voltage against the rotating anode 28 causing the emission of x-rays and a large amount of heat. The x-ray insert 26 includes a beryllium or other low Z metal window 32 mounted adjacent the cathode 30 and the x-ray permeable window 24 of the housing 22. The beryllium window 32 passes x-rays generated by the cathode 30 and the anode 28 out of the x-ray insert 26 through the x-ray permeable window 24 and into the patient receiving area 12. The beryllium window 32 is attached to the x-ray insert 26 by bending, brazing, or by any other suitable manner. Electrical leads for supplying current to the cathode 30 and leads for biasing the cathode 30 to a large, negative potential difference relative to the anode 28 pass through the envelope in a cathode well 34.

Once the x-rays pass through the x-ray permeable window 24 and across the patient receiving region 12, appropriate x-ray collimators focus the radiation into one or more planar beams which span the examination region 12 in a fan or cone pattern, as is conventional in the art. Other equipment associated with the x-ray tube B, such as a high voltage power supply 36 and a pump 38, are also mounted on the rotating frame C.

During operation of the x-ray tube B, the temperature of the beryllium window 32 tends to rise quickly. The rapid increase of the window temperature is caused not only by thermal radiation from the hot anode 28 inside the x-ray insert 26, but also by the kinetic energy from the secondary electrons impinging on the beryllium window 32 and its neighboring x-ray insert area. The dissimilar coefficients of thermal expansion of the beryllium window 32, the insert 26, and the bonding materials used to mount the window 32 to the x-ray insert 26 tend to create mechanical stresses that escalate as the temperature increases. Excessive window temperature is potentially dangerous for cracking the window joint, which can destroy the vacuum within the insert and cause failure of the x-ray tube B. A high window temperature can also overheat the cooling fluid near an outer surface of the window 32, deteriorating the dielectric characteristics of the cooling fluid, and increasing possibilities of high-voltage instabilities. Overheated cooling fluid near the window 32 is also detrimental because it could be carbonized and form particles. Electrically conductive carbon particles floating inside the x-ray tube B can deteriorate the stability of the fluid and cause arcing. This effect may decrease the quality of the x-ray image produced by the CT scanner.

Figure 3:
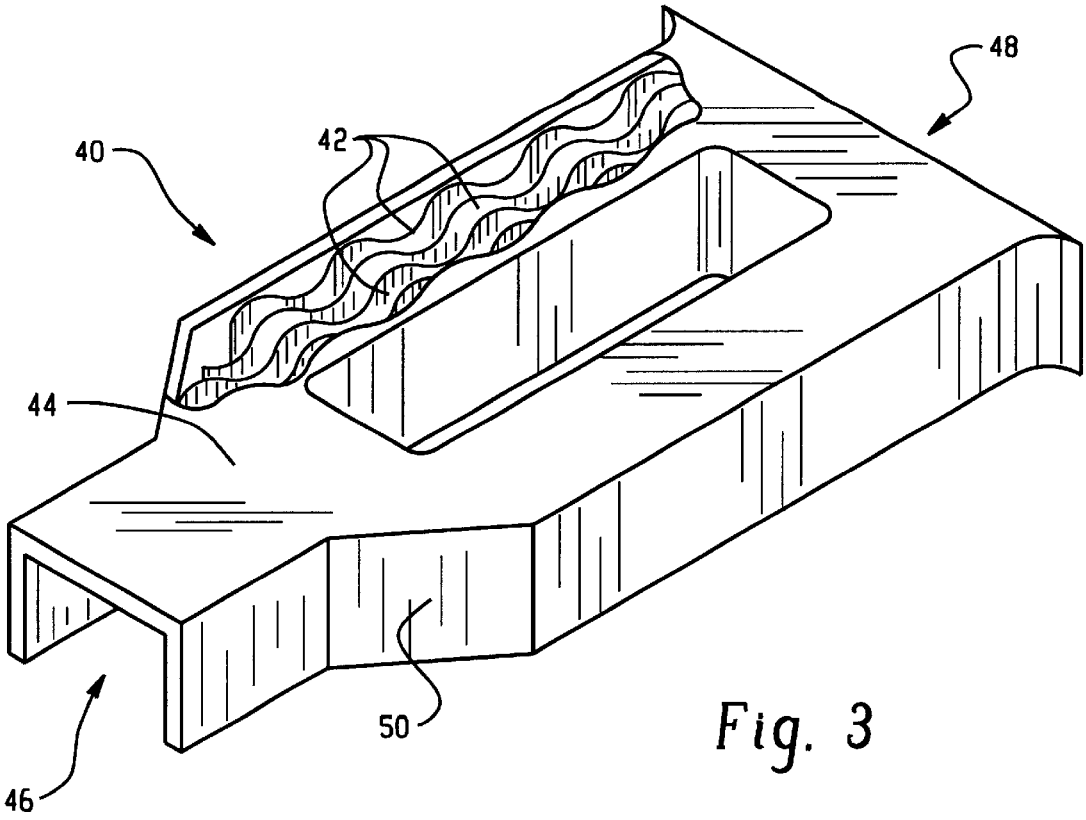
FIG. 3 is a perspective view of the cold-plate with a portion of a shell removed to show corrugated fins.

With additional reference to FIG. 3, a cold-plate 40 is integrated onto the beryllium 32 window for removing excess heat. The cold-plate 40 comprises a plurality of corrugated fins 42, a shell 44, an inlet 46, and an outlet 48. The corrugated fins 42 of thermally conductive material, such as beryllium or aluminum, are built on the rim area of the beryllium window 32 and its neighboring x-ray insert area. The shell 44 encloses the fins 42 and defines a fluid channel in a circumferential direction around the x-ray insert. The inlet 46, and the outlet 48 are oriented to direct flow along the longitudinal direction of the window 32. To reduce the pressure drop across the cold-plate 40, the inlet 46 contains a smooth expansion section 50 and the outlet 48 is wide open. When cooling fluid is provided to the cold-plate 40, the cooling fluid discharges through the outlet 48 and mixes with cooling fluid inside the x-ray tube housing 22. The shell 44 can be made of aluminum. Therefore, this aluminum shell can be also used as an x-ray filtration plate by setting its thickness as the required filtration thickness.

Alternatively, the cold-plate cover 40 can be made of titanium instead of aluminum. The advantage of using titanium is that this alloy has excellent x-ray transparent features. Further, the cover 40 can also be made of thermally conductive and x-ray transmissible plastics.

To cool the x-ray tube B, heated cooling fluid is circulated from the x-ray tube housing 22 through a first cooling fluid duct to the heat exchanger D on the rotatable frame C. Circulation of the cooling fluid is effected by the fluid pump 36. Cooled cooling oil exiting from the heat exchanger D is returned to the housing 22 via a second cooling fluid duct. The cooling fluid enters the housing 22 through an inlet aperture 52. The cooling fluid flows through the x-ray tube B absorbing heat created during x-ray generation. The fluid exits the housing 22 through an outlet aperture 54 into the first cooling fluid duct and recirculates back to the heat exchanger D.

Cooling fluid flowing to the inlet 52 of the x-ray tube B is distributed into two streams. A first stream of the fluid goes generally into the housing 22, whereas a second stream flows through a tube 56 to the cold-plate 40. The tube 56 fluidly connects to the inlet 46 of the cold-plate 40 and can be made of plastic or any other non-metallic material. Thus, the tube 56 provides cooling fluid directly to the beryllium window 32 via the cold-plate 40. The fluid exiting the tube 56 into the cold-plate 40 flows perpendicularly relative to the general flow of cooling fluid through the housing 22 around the cold-plate 40. The inlet 52 and outlet 54 of the x-ray tube housing 22 are at a first end of the housing 22, and separated by a first flow divider 54.

A second flow divider 58 is installed in the middle section of the housing 22 along an axial plane of the x-ray insert 26 and perpendicular to the direction of the inlet 52 of the housing 22. The second flow divider 58 is used for forcing the fluid to flow through the housing 22 in two passes. More specifically, the second flow divider 58 divides the housing 22 into a beryllium window cavity and an opposing cavity. The cavities are fluidly connected at the cathode side of the housing 22. The upper half of the x-ray insert 26, the upper half of the housing 22, and the second flow divider 58 generally define the beryllium window cavity. The lower half of the x-ray insert 26, the lower half of the housing 22, and the second flow divider 58 generally define the opposing cavity.

In operation, cooling fluid supplied from the heat exchanger D enters the inlet 52 of the x-ray tube housing 22. The cooling fluid is divided into first and second streams. The first stream enters generally into the x-ray housing 22 into the beryllium window cavity to cool the top half of the x-ray insert 26. The second stream flows to the cold-plate 36 through a tube 56 fluidly connecting the flow inlet 52 of the housing 22 and the inlet 46 of the cold-plate 40. The cooling fluid directed into the cold-plate 40 engages in vigorous heat transfer inside the cold-plate 40 while washing through the cold-plate 40. The cooling fluid exits the cold-plate 40 and mixes with the fluid flowing in the beryllium window cavity. The joined cooling fluid flows continuously towards the cathode end of the housing 22 before making a one-hundred-eighty degree turn over the second flow divider 58. The cooling fluid then flows into the opposing cavity and back to the outlet 54 of the housing 22 while cooling the bottom half of the x-ray insert 26. Cooling fluid exits the outlet 54 of the housing 22 and goes to the heat exchanger D to release the heat that it has absorbed from inside the x-ray tube housing 22.

To integrate the cold-plate 40 to the beryllium window 32, corrugated fins 42 are built around the rim area of the window 32 and the x-ray insert area neighboring the window 32. A shell 44 is brazed on the x-ray insert 26 thereby covering the window 32 and the fins 42 to form the cold-plate 40. A high volume of cooling fluid is driven into the cold-plate 40 to enhance the heat transfer from the fins 42 and the window 32. The cooling fluid to the cold-plate can be regulated and supplied through a flow director that may be placed at the inlet 52 to the x-ray housing 22.

Figure 4:
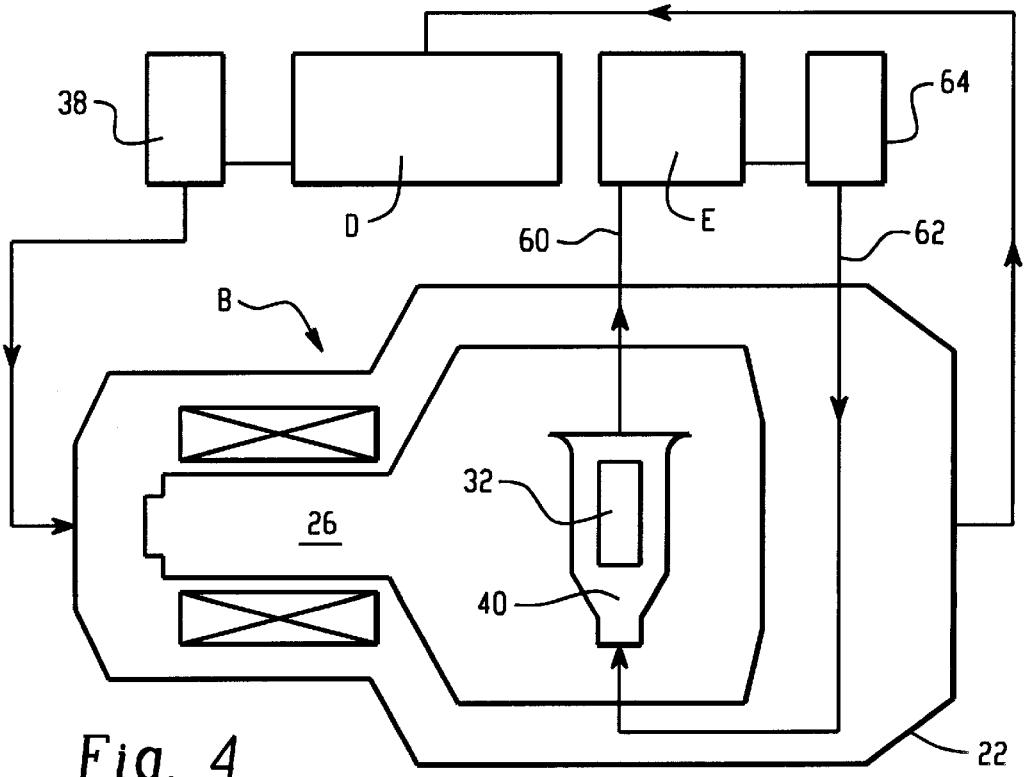
FIG. 4 is a diagrammatic illustration of a cooling system according to an alternate embodiment of the present invention.

With reference to FIG. 4, in an alternate embodiment of the present invention, a second and independent cooling loop is used to provide cooling fluid to the cold-plate 40. Cool cooling fluid is provided from a second heat exchanger E to the cold-plate 40 through a conduit 60. While flowing through the cold-plate 40, the cooling fluid removes heat from the beryllium window 32 and the area on the x-ray insert 26 surrounding the beryllium window 32. The heated cooling fluid discharges from the cold-plate 40 into a return conduit 62 and is circulated back to the heat exchanger E by a second pump 64. The first heat exchanger D continues to cool heated cooling fluid exiting the housing 22 of the x-ray tube B and provide cooled cooling fluid for circulation through the housing 22 by the pump 38.

The cooling fluid exiting the cold-plate 40 no longer merges with the cooling fluid flowing through the housing 22. Further, the cooling fluid flowing through the cold-plate 40 is not in fluid communication with the cooling fluid flowing through the x-ray housing. As a result, it is possible to introduce a non-dielectric and water-based fluid to cool the cold-plate 40. Use of such a cooling fluid will enhance the heat transfer of the cold-plate 40 while keeping the beryllium window 32 clean.

The invention has been described with reference to the preferred embodiments. Obviously, modifications and alterations will occur to others upon reading and understanding the preceding detailed description. It is intended that the invention be construed as including all such modifications and alterations insofar as they are within the scope of the appended claims or the equivalents thereof.

Having thus described the preferred embodiment, the invention is now claimed to be:

1. A CT scanner comprising:

an x-ray tube assembly mounted on a rotating frame portion, the x-ray tube assembly including a housing, an x-ray tube operatively mounted within the housing, and a cooling fluid reservoir defined between the x-ray tube and the housing, the cooling fluid reservoir including an inlet aperture through the housing and an outlet aperture through the housing;

an x-ray window mounted on the x-ray tube;

a cooling fluid circulation line in fluid communication with the inlet aperture of the cooling fluid reservoir and with a heat exchanger;

a cooling fluid return line in fluid communication with the heat exchanger and the outlet aperture of the cooling fluid reservoir;

a pump which circulates the cooling fluid through the heat exchanger, the circulation and return lines, and the x-ray tube housing assembly; and a cold-plate mounted on the x-ray tube around the x-ray window.

2. The CT scanner as set forth in claim 1 wherein the cold-plate includes corrugated fins for rapidly removing heat from the window and an area on the x-ray tube surrounding the window.

3. The CT scanner as set forth in claim 1 wherein the cold-plate includes:

a shell having corrugated fins disposed therein for thermal heat removal from the window and an area on the x-ray tube surrounding the window, the shell including an inlet and an outlet for cooling fluid flow therethrough.

4. The CT scanner as set forth in claim 3 wherein the shell is made of aluminum and has a portion that covers the window for x-ray filtration.

5. The CT scanner as set forth in claim 1 wherein the cold-plate has an inlet and an outlet, the inlet in fluid communication with the fluid circulation line, the outlet in fluid communication with the cooling fluid reservoir.

6. The CT scanner as set forth in claim 5 wherein the inlet includes a smooth expansion section to reduce the pressure drop across the cold-plate and the outlet is substantially larger than the inlet.

7. The CT scanner as set forth in claim 5 wherein the CT scanner further comprises:

a liquid line connected at one end to the inlet of the cold-plate and connected adjacent its other end to the inlet aperture of the housing; the cooling fluid from the circulation line divided between the cooling fluid reservoir and the liquid line at the inlet aperture.

8. The CT scanner as set forth in claim 5 wherein the cold-plate is elongated and oriented in the circumferential direction relative to the x-ray tube.

9. The CT scanner as set forth in claim 1 wherein the cooling fluid reservoir includes an upper portion and a lower portion, the upper portion defined by a first side of a flow divider, the x-ray tube, and the housing and in fluid communication with the inlet aperture and the lower portion, the lower portion defined by a second side of the flow divider, the x-ray tube, and the housing and in fluid communication with the outlet aperture and the upper portion.

10. The CT scanner as set forth in claim 9 wherein the inlet and outlet apertures are both located at one end of the housing and the window is located adjacent the upper portion, the inlet aperture allowing fluid to enter the housing into the upper portion of the fluid reservoir, pass through the upper portion into the lower portion, and exit through the outlet aperture.

11. An x-ray tube assembly comprising:

a housing having an x-ray window and defining a housing cavity therein;

an x-ray tube including a vacuum envelope which holds an anode and a cathode, the vacuum envelope having an x-ray translucent window adjacent the anode and in alignment with the x-ray window, the x-ray tube operatively mounted in the housing cavity spaced from the housing to define a cooling fluid reservoir therebetween; and a cold-plate operatively mounted on the x-ray translucent window.

12. The x-ray tube assembly as set forth in claim 11 wherein the cold-plate includes:

a shell and fins mounted therein, the fins mounted on a rim area of the x-ray translucent window and an area adjacent the x-ray translucent window on the x-ray tube.

13. The x-ray tube assembly as set forth in claim 12 wherein the shell is aluminum and used as an x-ray filtration plate.

14. The x-ray tube assembly as set forth in claim 11 wherein the cold-plate includes:

an inlet and an outlet, the inlet of the cold-plate includes a small expansion section and is located at a first end of the cold-plate and the outlet is wide open and located at a second end of the cold-plate, the inlet and the outlet oriented along the circumferential direction of the x-ray translucent window.

15. The x-ray tube assembly as set forth in claim 14 wherein the inlet of the cold-plate is in fluid communication with a liquid line, the cold-plate receives a cooling fluid at a higher flow rate than the cooling fluid flowing into the cooling fluid reservoir through an inlet in the housing.

16. The x-ray tube assembly as set forth in claim 14 wherein a cooling fluid flows into the fluid reservoir, a first portion of the cooling fluid flows directly into the fluid reservoir through an aperture in the housing and a second portion of the cooling fluid flows through a line in fluid communication with the inlet of the cold-plate.

17. The x-ray tube assembly as set forth in claim 11 wherein a flow divider is disposed in the fluid reservoir separating the fluid reservoir into an x-ray translucent window portion located adjacent the x-ray translucent window and a second portion located opposite the x-ray translucent window.

18. An x-ray tube comprising:

a vacuum envelope having an anode and a cathode with an x-ray window mounted thereon adjacent the anode;

a cold-plate including an elongated shell and a plurality of heat transfer elements positioned therein, the shell operatively mounted around the x-ray window and circumferentially oriented relative to the vacuum envelope, wherein the shell includes an inlet defined in a first end, an outlet defined in an opposite end, and an expansion section disposed therebetween.

19. A method of cooling an x-ray tube, the method comprising:

circulating a first portion of a cooling fluid over an x-ray tube to remove heat;

removing heat from an x-ray translucent window disposed on the x-ray tube by forcing a second portion of the cooling fluid through a cold-plate mounted around the periphery of the window;

cooling the cooling fluid and recirculating the cooling fluid around the window and over the x-ray tube.

20. The method as set forth in claim 19 wherein the step of removing heat from the window includes:

forcing the second portion of cooling fluid to flow in a circumferential direction relative to the x-ray tube.

21. The method as set forth in claim 19 wherein the step of removing heat from the window includes:

conducting heat removal with fins.

22. The method as set forth in claim 19 wherein the step of removing heat from the window by forcing a second portion of the cooling fluid around the window includes:

controlling the flow of the second portion of the cooling fluid relative to the flow of the first portion of cooling fluid.

23. The method as set forth in claim 19 further including:

building corrugated fins around a rim area of the window and an area adjacent the window on the x-ray tube;

brazing a shell on the x-ray tube, the shell enclosing the window and the corrugated fins to form the cold-plate.

* * * * *